United States Patent [19]

Kerkhoven

[11] 4,274,974

[45] Jun. 23, 1981

[54] PRODUCTION OF DETERGENT COMPOSITIONS

[75] Inventor: Frederik J. Kerkhoven, Vlaardingen, Netherlands

[73] Assignee: Lever Brothers Company, New York, N.Y.

[21] Appl. No.: 501,956

[22] Filed: Aug. 30, 1974

Related U.S. Application Data

[63] Continuation of Ser. No. 219,180, Jan. 19, 1972, abandoned.

[30] Foreign Application Priority Data

Feb. 3, 1971 [GB] United Kingdom ..... 3791/71

[51] Int. Cl.[3] ..... C11D 1/831; C11D 3/075; C11D 11/02; C11D 17/06

[52] U.S. Cl. ..... 252/90; 159/4 J; 252/109; 252/134; 252/135; 252/174; 252/174.21; 252/539; 252/540

[58] Field of Search ..... 252/109, 110, 121, 135, 252/539, 540, 90, 134, 174, 174.21; 159/4 J

[56] References Cited

U.S. PATENT DOCUMENTS

| | | | |
|---|---|---|---|
| 2,861,954 | 11/1958 | Ruff | 252/110 |
| 2,940,935 | 6/1960 | Reich | 252/109 |
| 3,121,639 | 2/1964 | Bauer | 159/4 J |
| 3,357,476 | 12/1967 | Tofflemire | 159/4 |
| 3,519,054 | 7/1970 | Cavataio | 159/48 |
| 3,538,004 | 11/1970 | Gabler | 252/99 |
| 3,849,327 | 11/1974 | Di Salvo | 252/109 |
| 3,868,336 | 2/1975 | Mazzola | 252/527 |

FOREIGN PATENT DOCUMENTS

| | | | |
|---|---|---|---|
| 931438 | 7/1963 | United Kingdom | 252/540 |
| 1232009 | 5/1971 | United Kingdom | 252/109 |

*Primary Examiner*—Dennis L. Albrecht
*Attorney, Agent, or Firm*—Farrell, James J.; Melvin H. Kurtz; Irving N. Feit

[57] ABSTRACT

A process is provided for the production of detergent compositions in particulate or powder form containing anionic and nonionic active-detergent materials, which process comprises forming at least two aqueous slurries A and B of detergent ingredients. Slurry A containing an active-detergent component comprising 60–100% by weight of anionic detergents and 0–40% by weight of nonionic detergents, slurry B containing an active-detergent component comprising 0–40% by weight of anionic detergents and 60–100% by weight of nonionic detergents, which slurries are treated as separate streams in a spray-drying equipment, after which the dried products are collected to form a homogeneous mixture of particulate materials comprising the detergent composition.

1 Claim, No Drawings

PRODUCTION OF DETERGENT COMPOSITIONS

This is a continuation of application Ser. No. 219,180, filed Jan. 19, 1972 and now abandoned.

BACKGROUND OF THE INVENTION

1. Field of the Invention

This invention relates to a process for the production of detergent compositions in particulate or powder form. More particularly it relates to the production of detergent compositions containing mixtures of anionic and nonionic detergent-active materials, by means of the spray-drying technique.

2. The Prior Art

The production of detergent compositions in particulate or powder form by spray-drying an aqueous slurry of detergent ingredients from nozzles located on a ring manifold placed in the upper portion of a spray-drying tower is known. The slurry is sprayed in a plurality of droplets which are dried to solid particles by the action of the drying gas passing through the spray-tower.

Detergent powders, particularly for fabric washing purposes generally contain 5–60% by weight, of active-detergent materials, 5–80% of builders, detergency improvers etc., and 0–50% of fillers and other additives. The normally used detergent-active compounds are anionic or nonionic in character but they may also be cationic or amphoteric, if desired.

The slurry-making and spray-drying of phosphate builder containing compositions generally do not present difficulties so long as the active-detergent component is not a mixture of different actives. The resulting powders of simple anionic compositions have normally satisfactory physical properties, i.e. they are sufficiently free-flowing and have very small tendency to caking on storage. However, combinations of two or more detergent-active compounds are often preferred to achieve optimal properties, e.g. as regards detergency action and/or foaming characteristics. Sometimes even more complex active mixtures may be desirable for specific purposes. The most commonly used active-detergent combination in the last decade includes a mixture comprising anionic synthetic non-soap detergents, fatty acid soaps and nonionic detergents.

Many of the present day heavy-duty detergent compositions having controlled sudsing characteristics suitable for use in drum-type washing machines comprise this typical active-detergent mixture or at least a mixture of anionic and nonionic synthetic detergents.

It has been observed that the conventional processing of the afore-mentioned "mixed-active" detergent compositions presents a number of problems, resulting also in unsatisfactory powders, which in many cases are unacceptable. In the conventional manner slurries are prepared either batch-wise, semi-cntinuously or continuously, but in all cases all the ingredients are mixed to one slurry with the sodium tripolyphosphate builder generally added at the end. The main problems one may be faced with when processing "mixed-active" detergent formulations are due to:

(1) Undesirable rheological properties of the slurry, such as high slurry viscosities;
(2) Separation of slurries in two or more liquid and solid phases;
(3) Poor solubility of powder;
(4) Poor free-flowing property and softness of powder and tendency to caking (5) Sensitivity of slurry and powder properties to small variations in the formulation, e.g. slurry viscosity, powder bulk density, solubility, free-flowiness.

Some of these problems could possibly be overcome or at least be influenced by the use of special measures. The addition of more water into the slurry reduces slurry viscosities, though obviously this would result in more spray-drying energy to evaporate additional water, reducing spray-tower capacity and still possibly give wet powders. The formation of small sodium tripolyphosphate hexahydrate crystals could have an improved effect on the free-flowing property of the powder. Better agitation would keep the slurry more homogeneous and possibly reduce the tendency to separate. Bulk density could be influenced by aeration or deaeration of the slurry.

Appart from the fact that these measures are each specifically directed to a particular aspect and which cannot always be altogether successfully applied to overcome the complex of problems, there are some more problems that cannot be solved by the conventional techniques. The possibility of using active-detergent mixtures in every variation and in all ratios, as desirably wanted for various performance reasons, has hitherto been restricted to a great extent, because the slurries cannot be properly processed in existing plants, even when the above measures are taken into account. It has also been observed that the above measures are not effective at all to overcome the stickiness of powders comprising certain mixtures of active-detergent materials. This lack of flexibility will be even more serious when the present tendency is considered to decrease the content of phosphates, particularly condensed phosphate detergency builders, such as sodium tripolyphosphate in detergent compositions, because of suggestions that such use of phosphates contributes to eutrophication. The corrective influence of the sodium tripolyphosphate hexahydrate crystals on powder properties will decrease when part of the phosphate is omitted or replaced by other non-phosphate builders, particularly organic builders.

SUMMARY OF THE INVENTION

It is an object of the present invention to provide a process for the production of mixed active-detergent compositions wherein the foregoing problems are eliminated or at least mitigated to a substantial degree.

DESCRIPTION OF THE INVENTION

According to the present invention a process for the production of a detergent composition containing a mixture of anionic and nonionic detergent-active materials is provided, which comprises forming at least two aqueous slurries A and B of detergent ingredients, of which slurry A contains an active-detergent component comprising 60–100% preferably 70–100% by weight of anionic detergents and 0–40% by weight of nonionic detergents, an slurry B contains an active detergent component comprising 0–40%, preferably 0–30% by weight of anionic detergents and 60–100% by weight of nonionic detergents, which slurries are treated as separate streams in a spray-drying equipment, after which the dried products are collected to form a homogeneous mixture of particulate materials comprising the detergent composition.

Separate treatment of the slurries can be realised by using a conventional spray-drying equipment, in which the slurries A and B are spray-dried successively, or by using a spray-drying tower which is provided with two or more separate nozzle systems, or if desired by using a plurality of spray-drying equipments.

The invention includes a detergent composition containing anionic and nonionic detergent-active materials made by the process of the invention. Such a composition, even when it is based on a complex mixture of anionic and nonionic active-detergent materials as desirably selected, can be made with good flowing and storage properties. The term "anionic" detergent-active material is used herein to indicate any anionic detergent including fatty acid soap, so that the compositions as contemplated by the present invention include both those comprising synthetic anionic, nonionic mixtures, as well as those comprising synthetic anionic, nonionic and soap mixtures.

Suitable anionic detergent-active compounds are water-soluble and have a hydrophobic long chain substituent containing at least 8 carbon atoms, generally 8 to 26 carbon atoms and preferably 12–20 carbon atoms, in their molecular structure and at least one water-solubilizing groups selected from the group consisting of sulphate, sulphonate, and carboxylate so as to form a water-soluble detergent. Examples of conventional anionic detergent-active compounds are $C_{10}$—$C_{18}$-alkylaryl sulphonates such as dodecylbenzene sulphonate and the linear secondary alkyl ($C_{10}$—$C_{15}$) benzene sulphonates; $C_{10}$—$C_{22}$-alkanesulphonates; $C_{10}$—$C_{22}$-alkyl and alkylether sulphates, such as lauryl sulphate, laurylether sulphate, etc.; $C_8$—$C_{30}$ fatty acid soaps, such as tallow soap, tallow/coconut soap, stearates, behenates and mixtures thereof; sulphuric acid esters of polyhydric alcohols incompletely esterified with higher fatty acids, either saturated or unsaturated, particularly those whose acyl groups contain from 12 to 18 carbon atoms, such as coconut oil monoglyceride monosulphate, tallow monoglyceride monosulphate, and the like. These various anionic detergents are used in the form of their water-soluble or water-dispersible salts such as the amine, alkali metal and alkaline earth metal salts. Examples are the sodium, potassium, magnesium salts, ammonium, monoethanolamine, diethanolamine, triethanolamine salts, and mixtures thereof.

As a suitable nonionic detergent-active compound any of the conventional water-soluble nonionic detergents can be mentioned.

Generally, such nonionics, which can be in liquid or paste form, have a hydrophobic group containing at least 8 carbon atoms and preferably 8–30 carbon atoms. One particular class of such detergents is that formed by the condensation of fatty acids, alcohols, alkylphenols, mercaptans, thiopenols, amines and amides with ethylene oxide and/or propylene oxide. Such materials usually have at least 4 moles of alkylene oxide and preferably 5 to 30 moles of alkylene oxide, depending upon the particular hydrophobic and hydrophylic group desired. Representatives of these materials are those formed by the condensation of ethylene oxide with alkylphenols, higher alcohols, fatty acids, or fatty acid amides, such as nonylphenol condensed with 10 moles ethylene oxide, tallow alcohol condensed with 9 moles ethylene oxide; tallow fatty acid amide condensed with 11 moles ethylene oxide; dinonylphenol condensed with 16 moles ethylene oxide; ethylene oxide condensate of coconut mono-ethanolamide; $C_{15}$-secondary alcohol condensed with 12 moles ethylene oxide etc. Another type of nonionic detergent materials known in the art is that which is formed by the condensation of ethylene oxide with polyoxypropylene.

It is an essential feature of the process of the invention that the active components of the detergent composition are split up as hereinbefore defined into at least two parts each forming with the builder-slurry an individual aqueous slurry treated separately in the manner as herein described. By the term "builder-slurry" used herein the aqueous slurry not comprising active-detergent materials is meant.

The builders which have been used extensively in detergent powders are inorganic builder salts, the condensed phosphate builders being in common usage. Examples of phosphate builders are the alkalimetal tripolyphosphates, pyrophosphates and ortho-phosphates, of which the sodium and potassium salts are generally used, either alone or in admixture. In the last few years a number of non-phosphate organic builders have been proposed as possible replacements for condensed phosphate detergency builders. These organic builders include the so-called polyelectrolyte builders such as sodium polyarylate, sodium polymaleate and copolymers thereof, such as sodium copolyethylene maleate and non-polymeric builders, such as sodium oxydiacetate and, sodium nitrilotriacetate. Further, preferred organic builders are the water-soluble salts of dicarboxylic acids of the formula $R.CH(COOH)(CH_2)_nCOOH$, wherein n is 0 or 1 and R is a primary or secondary straight-chain alkyl or alkenyl group containing from 10 to 20 carbon atoms, such as sodium alkenyl succinates. Other suitable organic builders are sodium salts of sulphonated fatty acids.

The method according to the present invention is particularly useful in processing detergent compositions of which the active-detergent component comprises a mixture of about 20–80% by weight of anionic detergents and about 20–80% by weight of nonionic detergents, and particularly those of which the anionic component comprises 10–90% by weight of fatty acid soap. Such compositions normally give processing difficulties when using conventional techniques, in that exceedingly thick slurries are obtained resulting in sticky powders with unsatisfactory free-flowing properties, especially when the nonionic proportion amounts to more than 30% of the active mixture.

Also difficult to process and to make into powders with good flowing and storage properties are further compositions in which the ratio between nonionic detergents and anionic sulphuric reaction products, such as alkylbenzene sulphonate, is within the range of about 9:1 and about 3:7.

In applying the process of the invention it is preferable that slurry A contains an as high a proportion as possible of the anionic detergents, usually within the range of 80–100% by weight of the anionic/nonionic mixture.

Advantageously the anionic detergents in slurry A should not comprise more than 70% of fatty acid soaps. This is particularly advisable in processing detergent compositions containing decreased amounts of condensed phosphate builders and substantial proportions of organic builders.

It is to be understood that in practising the invention more than two slurries may be made, if desired, so that in principle more than one slurry A and/or more than one slurry B may be provided within the described concept, although by doing so the multiple slurries A or the multiple slurries B need not necessarily be of identical formulations.

The simplest way of processing according to the invention so using two identical builder slurries, in one of which there is incorporated a detergent-active system comprising 60–100% by weight of anionic detergents and 0–40% by weight of nonionic detergents, and in the other a detergent-active system is incorporated comprising 0–40% of anionic detergents and 60–100% of nonionic detergent, forming thus the slurries A and B as hereinbefore indicated, the total amount of detergent materials being that and in the ratio which is contemplated for the final detergent composition, and spray-drying said slurries as separate streams in a spray-drying tower. It will be appreciated that the invention is not restricted to the use of one spray-drying tower either equipped with separate nozzle systems, or in which the separate slurries are successively spray-dried but extends to the use of as many towers as there are separate slurries, although the use of one tower is of course more preferred, particularly in terms of economy of investment.

It will also be further appreciated that the two builder slurries need not be essentially of identical compositions and that in carrying out the invention one is free to use a builder slurry composition of slurry A differing from that of slurry B, as varied as the case may be.

In a preferred embodiment of the invention the separate slurries are simultaneously fed as separate streams into one spray-drying tower through separate nozzle-systems which enter the tower at substantially equal height level. It has been found that from this arrangement quite satisfactory particles are obtained, forming directly the detergent composition in an homogeneous distribution.

The process according to the invention produces detergent compositions comprising essentially anionic and nonionic detergent-active materials, and condensed phosphate detergency builders or non-phosphate organic builders. In addition, the detergent compositions made by the process of the invention may contain minor amounts of conventional additives to detergent compositions, including inorganic salts, for example sodium silicate and sodium sulphate, chemical or optical bleaches, hydrotropes such as alkali metal aryl sulphonates, and anti-redeposition agents, for example sodium carboxy-methylcellulose. Germicides and/or enzymes may also be added, if desired.

Some ingredients are commonly added by admixture after the composition has been produced by spray-drying. Such additions are generally those which would be decomposed in some way during the spray-drying process, for example sodium perborate.

The invention is illustrated by the following examples in which parts or percentages are by weight.

EXAMPLE I

Two builder slurries I and II with about 40% water were prepared in a crutcher mixer, comprising the following ingredients:

| Ingredients | Parts by weight |
|---|---|
| sodium sulphate | 152 |
| sodium carboxymethylcellulose | 13 |
| alkaline sodium silicate | 87 |
| magnesium silicate | 13 |
| coconut ethanolamide | 3 |
| fluorescers | 3 |

-continued

| Ingredients | Parts by weight |
|---|---|
| sodium tripolyphosphate | 423 |

Builder slurry I was split up into two substantially equal parts A and B, whereas builder slurry II was kept as a whole. Into these builder slurries the following detergent-active materials were added:

| Active-detergents | A (parts) | B (parts) | II (parts) |
|---|---|---|---|
| sodium dodecylbenzenesulphonate | 52 | — | 52 |
| nonylphenol/10 ethylene oxide | 32 | 64 | 96 |
| sodium tallow soap | — | 38 | 38 |
| water content in slurry | 44% | 53% | 52% |

Slurries A and B were spray-dried separately and the powders collected from the bottoms of the tower were thoroughly mixed into a mixed powder I.

Slurry II, which contained the total amount of detergent-active materials, was also spray-dried and a powder II collected at the bottom of the tower was used for comparison.

The results are given in the table below:

TABLE

| | A | B | I | II |
|---|---|---|---|---|
| moisture content (%) | 14.6 | 15.4 | 14.7 | 14.8 |
| bulk density (g/l) | 406 | 314 | 346 | 346 |
| free flowing property (sec.) | 52 | 53 | 36 | 503 |
| compressibility (% rest volume) | 74.4 | 57.5 | 62.5 | 57.5 |

From the above Table the superiority in physical properties of powder I made by the process of the invention as compared wity powder II made by the conventional method is evident.

EXAMPLE II

Two builder slurries A and B of Example I were prepared in a crutcher mixer into which the following detergent-active materials were added:

| Active-detergents | A (parts by weight) | B (parts by weight) |
|---|---|---|
| sodium dodecyl benzene-sulphonate | 52 | — |
| nonylphenol/10 ethylene oxide | 17 | 79 |
| sodium tallow soap | 26 | 12 |
| water content in slurry | 45% | 45% |

Slurries A and B were spray-dried as separate streams through separate nozzle systems in one spray-drying tower. The powder collected from the bottom of the tower shows the following characteristics:

| | |
|---|---|
| moisture content (%) | 13.3 |
| bulk density (g/l) | 371 |
| free flowing property (sec.) | 27 |
| compressibility (% rest volume) | 59 |

EXAMPLE III

This example deals with a mixed active-detergent powder containing sodium tripolyphosphate and sodium nitrilotriacetate.

A detergent slurry I containing the following ingredients was prepared in a crutcher mixer:

| Ingredients | Parts by weight |
|---|---|
| sodium dodecylbenzene sulphonate | 6.50 |
| $C_{15}$-secondary alcohol condensed with 9 ethylene oxide | 5.00 |
| stearic acid | 2.78 |
| sodium hydroxide | 0.39 |
| sodium tripolyphosphate | 10.00 |
| sodium nitrilotriacetate | 15.00 |
| sodium carbonate | 20.00 |
| alkaline sodium silicate | 6.00 |
| sodium carboxymethylcellulose | 1.00 |
| water content | 44.5% |

The slurry separated in the crutcher. A slight improvement was observed after adding some more water. When this slurry was spray-dried, a powder was obtained which was rather sticky and creepy. The following powder characteristics were noted:

| | |
|---|---|
| moisture content (%) | 4.2 |
| bulk density (g/l) | 283 |
| free flowing property (sec.) | — |
| compressibility (% rest volume) | 43 |

The same slurry ingredients were processed according to the method of the invention. The following slurries A and B were prepared and spray-dried without difficulties.

| Ingredients | Parts by weight A | Parts by weight B |
|---|---|---|
| sodium dodecylbenzene sulphonate | 6.50 | — |
| $C_{15}$-sec. alcohol condensed with 9 ethylene oxide | — | 5.00 |
| stearic acid | 0.93 | 1.85 |

-continued

| Ingredients | Parts by weight A | Parts by weight B |
|---|---|---|
| sodium hydroxide | 0.13 | 0.26 |
| sodium tripolyphosphate | 5.00 | 5.00 |
| sodium nitrilotriacetate | 7.50 | 7.50 |
| sodium carbonate | 10.00 | 10.00 |
| alkaline sodium silicate | 3.00 | 3.00 |
| sodium carboxymethylcellulose | 0.50 | 0.50 |
| water content | 40.6% | 46.0% |

| Powder characteristics | Powder A | Powder B | Complete composition (=mixture) A + B) |
|---|---|---|---|
| moisture content (%) | 6.2 | 7.9 | 7.6 |
| bulk density (g/l) | 320 | 324 | 355 |
| free flowing properties (sec.) | 13 | 20 | 20.5 |
| compressibility (% rest volume) | 80 | 61 | 66 |

I claim:

1. A process for preparing a spray-dried detergent composition comprising by weight 5–80% of builders, 0–50% fillers and 5–60% of active detergent materials consisting essentially of a mixture of 20–80% by weight of anionic detergents of which 10–90% by weight is a fatty acid soap, and 80–20% by weight of nonionic detergents, which process comprises forming approximately equal proportions of at least two aqueous slurries A and B, slurry A being composed of a builder slurry incorporating therein an active detergent component consisting essentially of 60–100% by weight of anionic detergents and 0–40% by weight of nonionic detergents, slurry B being composed of a builder slurry incorporating therein an active detergent component consisting essentially of 0–40% by weight of anionic detergents and 60–100% by weight of nonionic detergents, simultaneously spray drying said slurries A and B in one spray-drying tower through separate nozzle systems, having points of entry on the tower at substantially equal height level of the tower, and collecting/mixing the dried products to form a homogeneous mixture of particulate material comprising said detergent composition.

* * * * *